US005838014A

United States Patent [19]

Cabib et al.

[11] Patent Number: 5,838,014

[45] Date of Patent: Nov. 17, 1998

[54] LASER BEAM BORESIGHTING APPARATUS

[75] Inventors: Dario Cabib; Moshe Lavi, both of Timrat; Arnold Daniels, Nof Haemek; Robert A. Buckwald, Ramat Ishay; Kurt Weiser, Haifa, all of Israel

[73] Assignee: CI Systems (Israel) Ltd., Migdal HaEmek, Israel

[21] Appl. No.: 437,067

[22] Filed: Nov. 16, 1989

[30] Foreign Application Priority Data

Nov. 18, 1988 [IL] Israel ..... 88409

[51] Int. Cl.[6] ..... F41J 2/02

[52] U.S. Cl. ..... 250/504 R; 250/495.1; 250/330; 273/348.1

[58] Field of Search ..... 250/493.1, 495.1, 250/504 R, 330; 273/348.1

[56] References Cited

U.S. PATENT DOCUMENTS 3,735,137 5/1973 Bly ..... 250/495.1
4,178,514 12/1979 Bly ..... 250/493.1

*Primary Examiner*—Jack I. Berman
*Attorney, Agent, or Firm*—Browdy and Neimark

[57] ABSTRACT

Boresighting apparatus includes a laser, a thermal target having an absorbent surface for receiving the laser beam and converting it to a heat spot of infrared radiation, and an optical device for receiving and optically displaying the heat spot. The thermal target is anisotropic, having a low thermal conductivity in the direction laterally of the surface and a high thermal conductivity in the direction perpendicular to the surface, so as to increase the duration of the heat spot with a minimum lateral spreading.

30 Claims, 2 Drawing Sheets

FIG 1
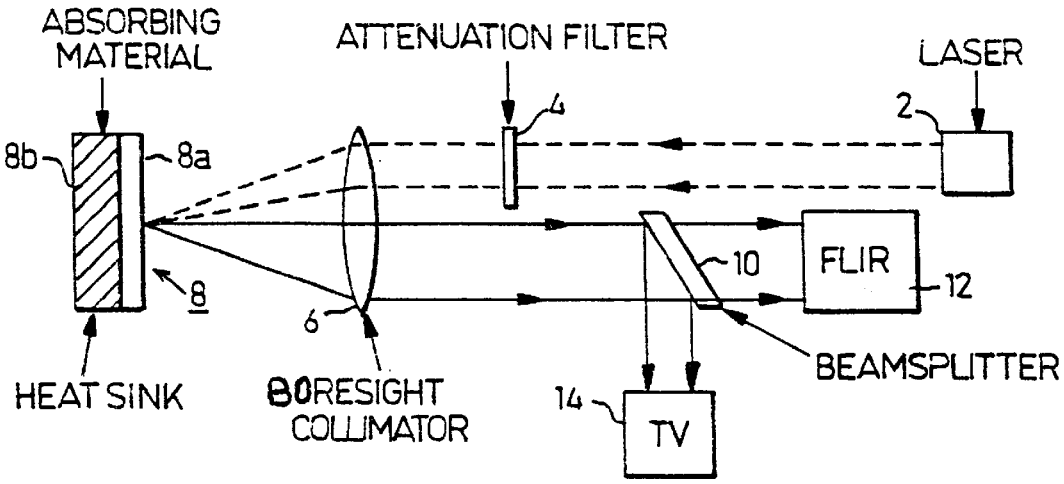
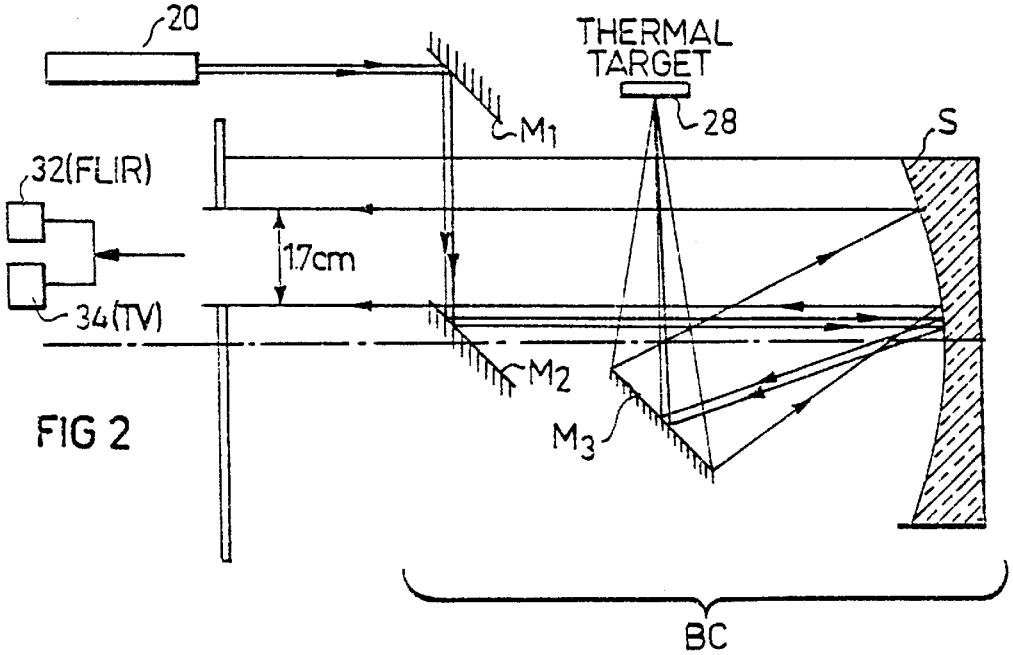
FIG 2
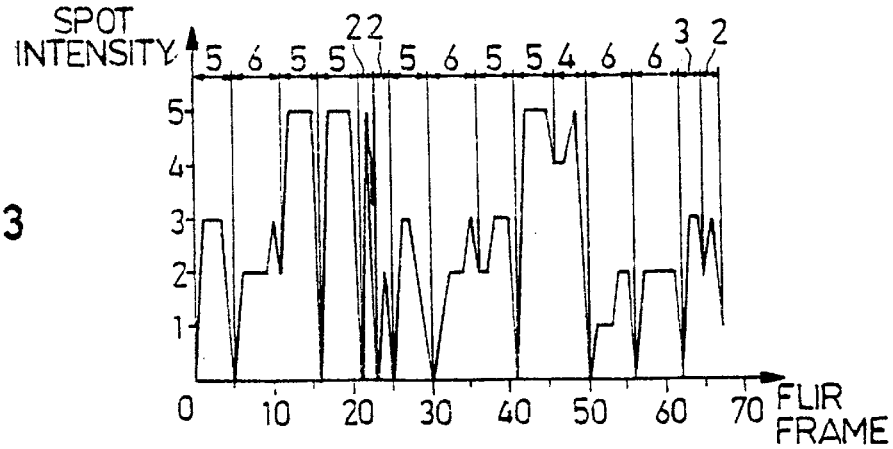
FIG 3

LASER BEAM BORESIGHTING APPARATUS

BACKGROUND OF THE INVENTION

The present invention relates to boresighting apparatus, and particularly to laser-type boresighting apparatus. The invention is particularly applicable to apparatus for boresighting a laser with a FLIR (Forward Looking Infrared Device), and is therefore described below with respect to this application.

Various laser-FLIR boresighting techniques are known, in which a laser beam is focused through a collimator on an absorbing material, called the thermal target, which heats up to a high temperature in the small region illuminated by the laser radiation. The infrared radiation so produced is re-emitted back by the hot region and is collimated in a direction parallel but opposite (or anti-parallel) to the incoming laser beam and appears on the FLIR screen as a bright, heated spot. Because of the high temperature of the heated spot and the reflective properties of the thermal target, radiation is emitted also in the visible and near infrared region of the spectrum, so that it can be detected by a video camera and can be seen directly through direct-viewing optics (DVO). Boresighting of the laser beam with the FLIR, video camera and/or DVO device can now be performed manually or automatically by rotating the laser or the sighting instruments, or their electronic cross hairs until the various lines of sight are centered with the heat spot.

In the known devices, the visible signal generally ends after about 10 microseconds, and the infrared effective temperature difference drops below the FLIR threshhold detection after a few milliseconds. Since the FLIR frame time and frame period are of the order of tens of milliseconds, there is only a small chance that the optical scanning mechanism of the FLIR will catch the heat spot, unless the pulses and the FLIR frames are synchronized. The size of the heat spot detected by the various viewing instruments (and to some extent its shape and stability) is important because it ultimately determines the accuracy with which the boresighting can be performed. The size of the spot is determined primarily by the laser divergence, but there are additional broadening effects which come into play such as: quality of the optics used to focus the laser, diffraction, spreading of the heat spot because of heat conduction in the thermal target, random vibrations when the system is mounted on a moving platform, and apparent spot narrowing effects such as the one due to detection threshhold of the FLIR or of the video camera.

An advantage of the known system described above is that the radiation flashes from the thermal target are very short (e.g. 10 microseconds), and therefore no appreciable broadening of the spot because of heat conduction and vehicle vibrations is present. However, this known technique involves the following drawbacks: (1) the pulses of heat produced are so short (e.g. 10 microseconds) that the FLIR may not detect them unless the laser pulses and the FLIR frames are synchronized, which is very cumbersome and sometimes not even practical or possible; and (2) the thermal target heats up to a very high temperature, which results in a short target lifetime.

OBJECTS AND SUMMARY OF THE INVENTION

An object of the present invention is to provide boresighting apparatus having advantages in one or both of the above respects.

According to the present invention, there is provided boresighting apparatus comprising: a laser for emitting a laser beam, a thermal target having an absorbent surface for receiving the laser beam and for converting same to a heat spot of infrared radiation, and an optical device for receiving and optically displaying the heat spot; characterized in that the thermal target is anisotropic, having a low thermal conductivity in the direction laterally of the surface and a high thermal conductivity in the direction perpendicular to the surface, so as to increase the duration of the heat spot with a minimum lateral spreading thereof.

According to a more particular feature of the present invention, the thermal target is a composite device, including a first layer facing towards the laser and having a low thermal conductivity, and a second layer facing away from the laser and having a high thermal conductivity.

The second layer having a high thermal conductivity is substantially thicker than the first layer, such that the second layer also minimizes the temperature rise of the thermal target, thereby lessening possible damage by sputtering and increasing the useful life of the thermal target; preferably, the second layer is thicker than the first layer by several orders of magnitude.

As one described example, the second layer, called the heat-sink layer, may be of metal, such as stainless steel, having a thickness of 1.5 mm; and the first layer, called the absorbing layer, may be of glass bonded to the second layer and having a thickness of about 100 microns.

It will thus be seen that apparatus constructed in accordance with the foregoing features allows direct boresighting between a laser and a FLIR, and between a laser and a video camera, without the need for complicated electronic circuitry to synchronize the laser pulse with the FLIR scanning. In addition, the heat spot does not spread thermally, and is not appreciably affected by vehicle vibrations. Further, since the thermal target works at a relatively low temperature, it has a relatively long useful life.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a schematic diagram illustrating one form of boresight apparatus constructed in accordance with the present invention;

FIG. 2 is a schematic diagram illustrating another type of boresighting apparatus constructed in accordance with the present invention;

FIG. 3 is a diagram illustrating the relation of heat spot intensity versus time as seen on the FLIR in the apparatus of FIG. 2;

DESCRIPTION OF PREFERRED EMBODIMENTS

Figure 4:
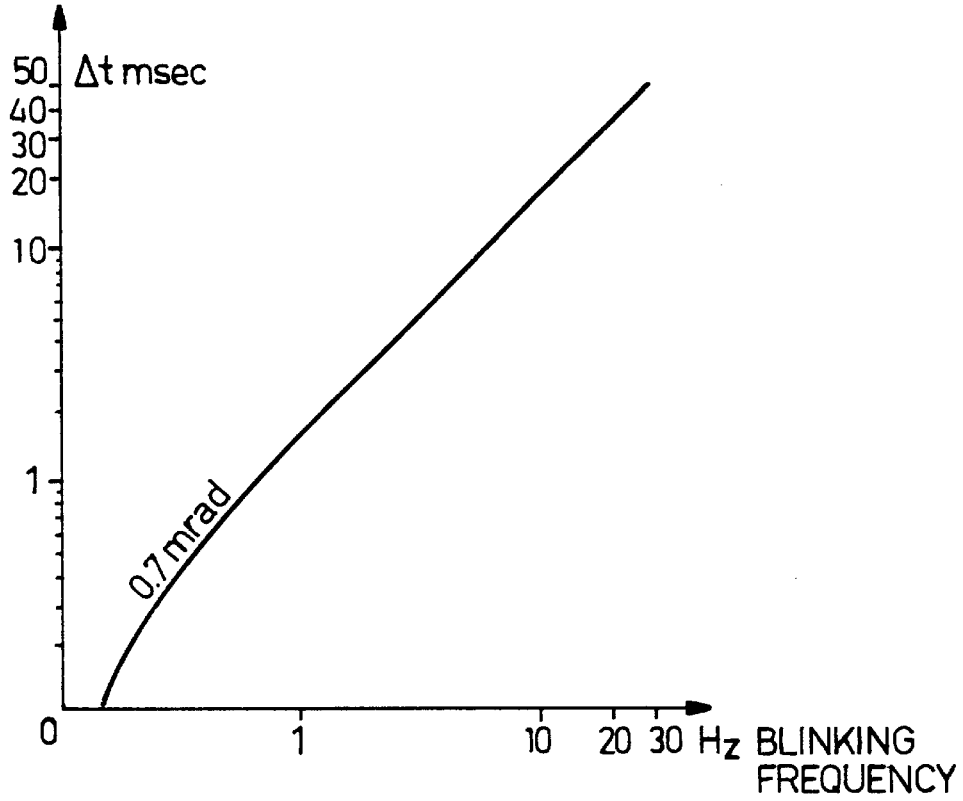
FIG. 4 is a diagram illustrating the heat spot duration as function of blinking frequency in the apparatus of FIG. 2.

With reference to FIG. 1, there is illustrated a boresighting apparatus including a laser 2 for emitting a laser beam which first passes through an attenuation filter 4 and then through a boresighting collimator 6, which focuses the laser beam as a small spot on the absorbing surface of a thermal target 8. The spot illuminated by the laser radiation heats up to a high temperature producing infrared radiation which is re-emitted back via the collimator 6 in a direction parallel but opposite (or anti-parallel) to the incoming laser beam. The infrared radiation is directed through a beam splitter 10 which transmits a portion of the radiation to a FLIR device 12 and reflects the other portion to a video camera 14. The infrared radiation thus appears as a bright spot on the screen of the FLIR device 12 and also on the screen of the video camera 14.

In the known method, the visible signal ends after about 10 microseconds, and the infrared-effect temperature difference drops below the threshhold detection of the FLIR device 12 after a few milliseconds. Since the FLIR frame time and frame period are generally of the order of tens of milliseconds, there is only a small chance that, in the conventional system, the optical scanning mechanism of the FLIR device 12 will catch the heat spot unless the pulses of the laser 2 and the frames of the FLIR device 12 are synchronized.

Such synchronization is not required in the apparatus constructed in accordance with the present invention as illustrated in FIG. 1 because of the construction of the thermal target 8. Thus, the thermal target in FIG. 1 is constructed so as to exhibit anisotropic behavior, in that it has low thermal conductivity in the direction lateral to the absorbing surface of the thermal target 8, and has high thermal conductivity in the direction perpendicular to the absorbing surface of the thermal target.

More particularly, and as illustrated in FIG. 1, the thermal target 8 is a composite device including a first layer 8*a* facing towards the laser 2 and having a low thermal conductivity, and a second layer 8*b* facing away from the laser and having a high thermal conductivity.

Layer 8*a*, facing the laser 2 and having low thermal conductivity, absorbs the laser wavelength and has a high emissivity outside the laser wavelength. For example, the laser 2 may be a Nd-Yag laser having a wave length of 1.06 microns, and the absorbing layer 8*a* of the thermal target may be glass having a high emissivity in the 8–12 micron region.

Layer 8*b* of the thermal target 8, which layer has very high thermal conductivity, acts as a heat sink by spreading the heat that reaches it into a large space volume in a very short time. This layer should have a thickness substantially larger, preferably several orders of magnitude larger, than the thickness of layer 8*a*.

The thickness of the absorbing layer 8*a* is also important: it must be large enough to absorb enough laser energy, but it must be thin enough, so that the time required by the heat pulse to reach the heat sink is not too long: in fact, it should be just long enough to be seen by the FLIR without synchronization, (about 30 msec) and to cool down before the new laser pulse heats the spot again.

It can be shown by solving the heat equation, that the following holds:

1. The temperature decay time is given by $$\tau=d^2/K \tag{1}$$

where K is the diffusivity of the absorbing material.

$$K=K/\rho C \tag{2}$$

and d is the thickness of the absorbing material. (The diffusivity of the heat sink is several orders of magnitude higher so that it does not contribute to $\tau$)

2. The temperature dependence of the heat spot can be represented by an exponential decay $$\Delta T(t)=\Delta T(O)e^{-t}/\tau \tag{3}$$

where $\tau$ is given by Eq. (1) and t is the time. $\Delta T(O)$ is the actual (t=0) temperature rise-of the thermal target (see Eq. 7 below).

3. The lateral heat spread is given by:

$$l=\sqrt{\tau K} \tag{4}$$

(similar to eq. (1)).

4. The heat spot diameter after a time $\tau$ from the laser pulse occurrence is given by:

$$L=l+lo \tag{5}$$

where lo is the initial spot diameter, given by the laser and optics geometry. L is an estimate of the spot size seen by the FLIR, as an average, even though it is actually time dependent.

5. $\Delta T(\mathbf{0})$ depends on the laser pulse energy J, the heat capacity C of the absorbing material and its density $\rho$ and the volume V initially heated:

$$V=A\alpha^{-1} \tag{6}$$

($\alpha$=absorption coefficient at the laser energy and A is the laser cross-sectional area on the focal plane.

$$\Delta T(\mathbf{0})=J/\rho CV \tag{7}$$

6. The boresight accuracy B is arbitrarily defined as $$B=L/7 \tag{8}$$

The factor seven is an empirical value based on experience.

7. Eq. (5) can be expressed in terms of the focal length F of FIG. 2 and the divergence $\theta$ of the laser:

$$L=l+F\theta \tag{9}$$

In order to achieve a working device, the materials for the thermal target must have parameters which, when used in Eqs. (1) to (9) for a certain laser, yield the required value of B or smaller. The thickness d and the focal length F are free parameters which can also be adjusted.

FIG. 2 illustrates an embodiment of the invention which has been tested in practice.

The thermal target, generally designated 28 in FIG. 2, is of the same construction as target 8 in FIG. 1, in that it includes a first layer (corresponding to layer 8*a*, FIG. 1) facing towards the laser beam and having a low conductivity, and a second layer (corresponding to layer 8*b*) facing away from the laser beam and having a high thermal conductivity. In the illustrated construction, the low-conductivity layer is a specially selected glass having high emissivity in the 8 to 12 micron region, and is of a thickness of 100 microns; whereas the high-conductivity layer 8*b* is of metal, e.g. stainless steel, of 1.5 mm thickness, to which the low-conductivity layer has been glued.

The apparatus illustrated in FIG. 2 further includes two diagonal flat mirrors $M_1$, $M_2$. These mirrors reflect the laser beam to a spherical mirror S which focuses the laser beam onto an additional flat mirror $M_3$. The latter mirror reflects the focused beam to a point on the thermal target 28.

The mirrors $M_1$, $M_2$, $M_3$ and S, correspond to the boresight collimator 6 in FIG. 1, in that they focus the laser beam onto the thermal target 28, and also collimate the infrared radiation re-emitted back by the thermal target in a direction parallel but opposite (or anti-parallel) to the incoming laser. The collimated infrared radiation is directed to a FLIR device and/or to a video camera. Thus, as described earlier, the infrared radiation emitted by the thermal target 28 appears on the screen of the FLIR device as a bright spot, and the visible and near infrared region of the emitted radiation appears on the video camera also as a bright spot.

The boresight collimator unit BC illustrated in FIG. 2 must be aligned optically so that the thermal target 28 is in such a plane that the focused laser spot is of minimum size. This is needed to obtain the best boresighting accuracy possible. For this purpose, the spherical mirror S is movable along its optical axis, and the flat mirror $M_1$ is rotatable around an axis perpendicular to its optical axis, i.e. perpendicular to the plane of the paper.

Optical alignment of the boresight collimator unit BC may be performed by illuminating the thermal target 28 with an autocollimator placed in front of it. The autocollimator is set at infinity, and the spherical mirror S is adjusted until the reflected light from the thermal target 28 into the auto collimator shows best focus. Flat mirror $M_1$ can be rotated to keep the spot centered with the thermal target. In this position, the thermal target 28 is on the focal plane of the spherical mirror S. After optical alignment, the laser 20 may replace the auto-collimator, and the video camera or the FLIR device may be used to fine adjust the position of the spherical mirror S until the spot size seen on the screen is minimized.

During the observations of the heat spot on the FLIR screen, an additional effect was observed: the heat spot was blinking on and off at a certain average frequency. This fact immediately suggests that the time duration of the heat spot temperature is of the same order of magnitude as the FLIR frame time, as in a beating phenomenon. In fact, if the spot temperature decay time is much shorter than the frame time, the probability of seeing the spot is almost nil, and it would be necessary to synchronize the laser pulses with the FLIR frames in order to detect the spot. Conversely, if the heat spot duration is very long compared with the frame time, the spot intensity would not decrease to zero on the screen. The described operation is clearly in an intermediate situation, where the spot is seen intermittently.

In order to make a more in-depth analysis, each video frame was analyzed separately. FIG. 3 shows the approximate spot intensity versus time.

The intensity scale has been divided into six values from 0 to 5 as estimated by the eye, and therefore it is not exact. The unit of time on the coordinate axis is the frame time (33 msec). An average blinking period (T) is defined as the average time between two successive nodes in the heat spot intensity curve of FIG. 3 (a node is a time at which the intensity is equal to zero). Thus:

$$T=0.15 \text{ sec} \tag{10}$$

The average blinking frequency f of the heat spot is defined as:

$$f=1/T=6.7 \text{ Hz} \tag{11}$$

It is well known that an event which repeats itself at frequencies higher than 13 Hz is seen by the eye as constant, whereas it is resolved for lower frequencies. This is the reason the heat spot is seen blinking.

In order for the heat spot to be seen on the FLIR video, the instantaneous field of view of the FLIR must coincide with a region on the heat spot at a certain instant. The number of times this event happens per second is a function of two parameters, (for fixed FLIR frame rate and laser pulse rate): (1) the heat spot size, and (2) the heat spot time duration.

A computer simulation has been built in which a train of pulses representing the heat spot temperature was made to overlap with another train representing the FLIR frames. This was done for different heat spot sizes and heat spot time durations. A small jitter in the period of the heat spot (corresponding to a jitter in the laser pulse rate) was also introduced into the model, since this can affect the final results. The results obtained are summarized in FIG. 4.

FIG. 4 shows, in a double logarithmic scale, the heat spot duration ($\Delta t$) as function of blinking frequency, for a spot size of 0.7 mrad. For a low blinking frequency of 6 Hz and a spot size of 0.7 mrad a spot duration of 10 msec is obtained.

Figure 5:
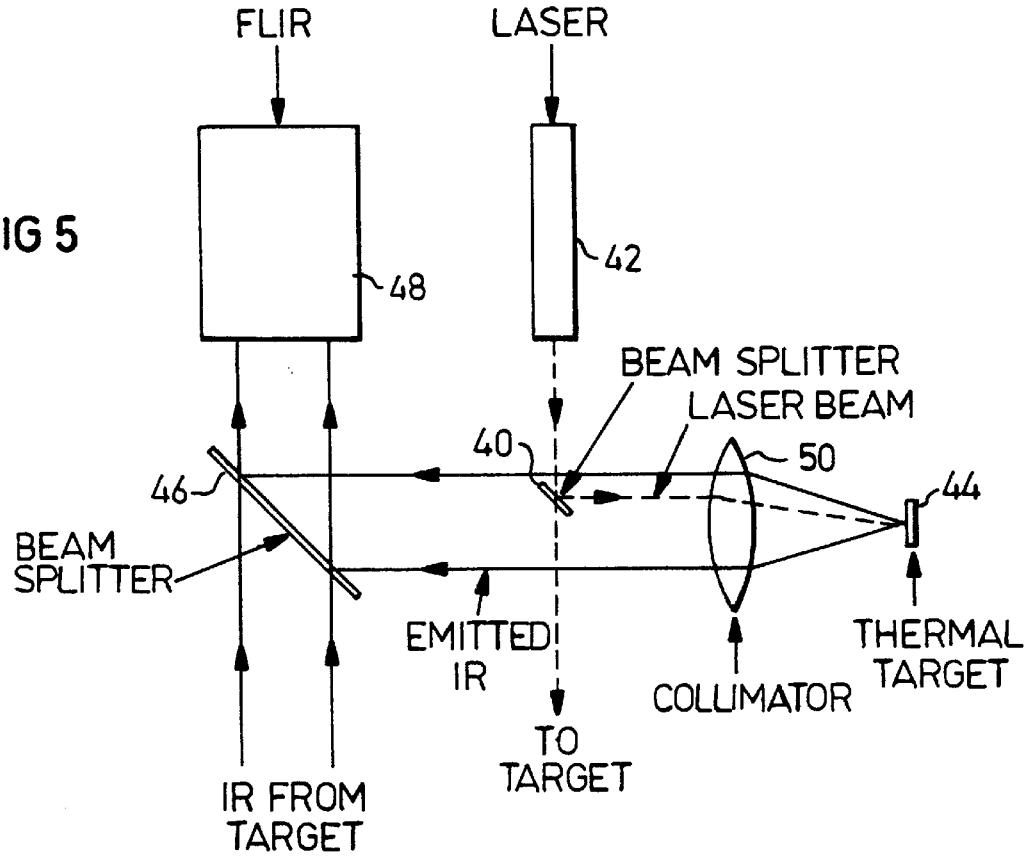
FIG. 5 is a schematic diagram illustrating another type of boresighting apparatus constructed in accordance with the present invention for boresighting in a real time manner.

FIG. 5 illustrates a further embodiment of the invention which allows real time boresighting. This means that the laser and the FLIR device can be boresighted while the FLIR device looks at the scenery.

Thus, the apparatus illustrated in FIG. 5 includes a first beam splitter 40 between the laser 42 and thermal target 44, and a second beam splitter 46 between the FLIR device 48 and the thermal target 44. Beam splitter 40 reflects a part of the laser beam 42 to the thermal target 44, and transmits another part to the scenery being examined. Collimator 50 focuses the reflected part of the laser beam on the thermal target 44. Target 44 is of the same construction as target 8 in the apparatus described above with respect to FIG. 1, and converts the laser beam to a heat spot of infrared radiation, which radiation is collimated by collimator 50 and reflected by beam splitter 46 to the FLIR device 48. Beam splitter 46 also transmits to the infrared radiation from the scenery being viewed to the FLIR device 48, thereby permitting real time boresighting while the FLIR device looks at the scenery.

While the invention has been described with respect to several preferred embodiments, it will be appreciated that many other variations, modifications and applications of the invention may be made.

What is claimed is:

1. A system for converting laser light having a laser wavelength into infrared radiation outside the laser wavelength, comprising:

a thermal target comprising a substrate of high thermal conductivity and a layer of low thermal conductivity target material applied to a surface of said substrate;

means for allowing the impingement of laser light of said laser wavelength onto said target; and means for utilizing the resultant radiation of infrared radiation outside the laser wavelength emitted by the target.

2. A system in accordance with claim 1 wherein said substrate of high thermal conductivity is a metal.

3. A laser-FLIR boresighting system, comprising:

a laser device for generating a beam of laser light along a first axis;

a FLIR sensor aligned along a second axis substantially aligned with said first axis;

an infrared target comprising a substrate of high thermal conductivity and a layer of low thermal conductivity target material applied to a planar surface of said substrate; and a collimating mirror system including a concave reflecting surface disposed with respect to to said laser light beam and said target to intercept and reflect said beam onto said target, said mirror system further being arranged with respect to said FLIR sensor so as to reflect corresponding infrared radiation emitted by said infrared target substantially along said second axis.

4. A boresighting system in accordance with claim 3, wherein said substrate of high thermal conductivity comprises a metal.

5. A laser-FLIR boresighting system, comprising:

a laser device for generating a beam of laser light along a first axis;

a FLIR sensor aligned along a second axis parallel to said first axis;

an infrared target comprising a substrate of high thermal conductivity and a layer of low thermal conductivity target material applied to a planar surface of said substrate; and a collimating mirror system including a spherical mirror disposed with respect to to said laser light beam and said target to intercept and reflect said beam onto said target, said mirror system further being arranged with respect to said FLIR sensor so as to reflect corresponding infrared radiation emitted by said infrared target substantially along said second axis.

6. A system for converting laser light having a laser wavelength into infrared radiation outside the laser wavelength, comprising:

a thermal target having a substrate and a layer thereon, wherein said layer is thin and of low thermal conductivity relative to said substrate and said substrate is thick and of high thermal conductivity relative to said layer, so as to minimize lateral spreading of a spot emitting said infrared radiation outside the laser wavelength from said layer for the duration of said spot, produced in response to the impingement of the laser light on said laser;

means for causing the impingement of laser light of said laser wavelength onto said layer; and infrared detector means for receiving and detecting the resultant radiation of infrared radiation outside the laser wavelength emitted by said layer.

7. The system according to claim 6, wherein said substrate is thicker than said layer by several orders of magnitude.

8. The system according to claim 6, wherein said layer is glass and said substrate is metal.

9. The system according to claim 6, wherein said means for causing impingement comprises optical means for focusing the laser light onto said layer and said infrared detector means comprises an optical device for receiving said infrared radiation emitted by said layer and optically displaying said spot, and collimating means for collimating said infrared radiation emanating from the spot of the thermal target onto said optical device.

10. The system according to claim 9, wherein sail optical means and said collimating means comprise a first diagonal flat mirror, a second diagonal flat mirror, a focusing spherical mirror, and a third diagonal flat mirror, for focusing the laser light onto the thermal target, the spot from the thermal target being collimated by said third flat mirror and said spherical mirror before reaching said optical device.

11. The system according to claim 10, wherein said spherical mirror is movable along its optical axis, and said first flat mirror is rotatable about an axis perpendicular to its optical axis.

12. The system according to claim 9, further including laser means for emitting the laser light and a beam splitter between said laser means and said thermal target effective to reflect a portion of the laser light to the thermal target and to transmit another portion externally of the apparatus.

13. The system according to claim 12, further including another beam splitter between said thermal target and said optical device and effective to reflect the infrared radiation from the thermal target to the optical device and also to transmit radiant energy emanating externally of the apparatus also to the optical device.

14. The system according to claim 6, wherein said laser light has a wavelength of $1.06\mu$, and said layer of the thermal target is glass having a high emissivity in the 8 to $12\mu$ region.

15. The system according to claim 6, wherein said infrared detector means is or includes a FLIR device.

16. The system according to claim 6, wherein said infrared detector means is or includes a video camera.

17. A system for converting laser light having a laser wavelength into infrared radiation outside the laser wavelength, comprising:

a thermal target having an absorbent surface for receiving the laser light and for converting same to a heat spot of infrared radiation, said thermal target having a low thermal conductivity in the direction laterally of said surface and a high thermal conductivity in the direction perpendicular to said surface so as to increase the duration of the heat spot with a minimum lateral spreading thereof;

means for allowing the impingement of laser light of said laser wavelength onto said target; and means for utilizing the resultant radiation of infrared radiation outside the laser wavelength emitted by the target.

18. A system in accordance with claim 17, wherein said thermal target is a composite device, including a first layer facing towards the laser light and having a low thermal conductivity, and a second layer facing away from the laser light and having a high thermal conductivity.

19. A system in accordance with claim 18, wherein said second layer having a high thermal conductivity is substantially thicker than said first layer, such that the second layer also minimizes the temperature rise of the thermal target, thereby lessening possible damage by sputtering and increasing the useful life of the thermal target.

20. A system in accordance with claim 19, wherein said second layer having a high thermal conductivity is thicker than said first layer by several orders of magnitude.

21. A system in accordance with claim 18, wherein said first layer is glass, and said second layer is metal.

22. A system in accordance with claim 17, further including a laser source for emitting laser light and an optical device for receiving and optically displaying the heat spot.

23. A system in accordance with claim 22, wherein said means for allowing impingement of laser light onto the target comprises means for focusing the laser beam onto the target and wherein said means for utilizing the resultant radiation comprises means for collimating the radiation emanating from the heat spot of the thermal target onto the optical device.

24. A system in accordance with claim 23, wherein said means for focusing the laser beam comprises a first diagonal flat mirror, a second diagonal flat mirror, a focusing spherical mirror, and a third diagonal flat mirror, and said means for collimating comprises said third flat mirror and said spherical mirror.

25. A system in accordance with claim 24, wherein said spherical mirror is movable along its optical axis, and said first flat mirror is rotatable about an axis perpendicular to its optical axis.

26. A system in accordance with claim 23, further including a beam splitter between said laser source and said thermal target effective to reflect a portion of the laser beam to the thermal target and to transmit another portion externally of the apparatus.

27. A system in accordance with claim 26, further including another beam splitter between said thermal target and said optical device and effective to reflect the infrared radiation from the thermal target to the optical device and also to transmit radiant energy emanating externally of the apparatus also to the optical device.

28. A system in accordance with claim 18, further including a Nd-Yag laser having a wavelength of 1.06$\mu$, and wherein said first layer of the thermal target is glass having a high emissivity in the 8 to 12$\mu$ region.

29. A system in accordance with claim 22, wherein said optical device is or includes a FLIR device.

30. A system in accordance with claim 22, wherein said optical device is or includes a video camera.

* * * * *

UNITED STATES PATENT AND TRADEMARK OFFICE

CERTIFICATE OF CORRECTION

PATENT NO. : 5,838,014

DATED : November 17, 1998

INVENTOR(S) : Dario Cabib; Moshe Lavi; Arnold Daniels; Robert A. Buckwald; Kurt Weiser It is certified that error appears in the above-identified patent and that said Letters Patent is hereby corrected as shown below:

Column 3, line 60, (Equation 1), change "$d^2/K$" to --$d^2/\kappa$--.
Column 3, line 61, change "K" to --$\kappa$--.
Column 3, line 64, (Equation 2), change "K=" to --$\kappa$=--.
Column 7, line 6, (claim 3, line 11), after "respect", delete "to".
Column 7, line 25, (claim 5, line 11), after "respect", delete "to".

Signed and Sealed this

Twenty-seventh Day of July, 1999

*Attest:*

Q. TODD DICKINSON

*Attesting Officer*

*Acting Commissioner of Patents and Trademarks*